US009097424B2

(12) United States Patent
Chen et al.

(10) Patent No.: US 9,097,424 B2
(45) Date of Patent: Aug. 4, 2015

(54) SYSTEM FOR SUPPLYING A FUEL AND WORKING FLUID MIXTURE TO A COMBUSTOR

(75) Inventors: Wei Chen, Greer, SC (US); Lucas John Stoia, Taylors, SC (US); Richard Martin DiCintio, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 777 days.

(21) Appl. No.: 13/417,405

(22) Filed: Mar. 12, 2012

(65) Prior Publication Data

US 2013/0232980 A1 Sep. 12, 2013

(51) Int. Cl.

| | |
|---|---|
| ***F23R 3/06*** | (2006.01) |
| ***F23R 3/04*** | (2006.01) |
| *F23R 3/34* | (2006.01) |
| *F01D 9/02* | (2006.01) |
| *F23R 3/28* | (2006.01) |
| *F23C 6/04* | (2006.01) |

(52) U.S. Cl.
CPC ..... *F23R 3/045* (2013.01); *F01D 9/023* (2013.01); *F23C 6/047* (2013.01); *F23R 3/283* (2013.01); *F23R 3/346* (2013.01)

(58) Field of Classification Search
CPC ..... F01D 9/023; F23C 6/047; F23R 3/002; F23R 3/005; F23R 3/283; F23R 3/286; F23R 3/045; F23R 3/346
USPC ..... 60/39.37, 733, 737, 740, 746, 747, 759
See application file for complete search history.

(56) References Cited

U.S. PATENT DOCUMENTS

| | | | | |
|---|---|---|---|---|
| 2,922,279 | A | | 1/1960 | Roberson et al. |
| 3,303,645 | A | * | 2/1967 | Ishibashi ..... 60/755 |
| 3,934,409 | A | | 1/1976 | Quillevere et al. |
| 4,040,252 | A | | 8/1977 | Mosier et al. |
| 4,045,956 | A | | 9/1977 | Markowski et al. |
| 4,112,676 | A | | 9/1978 | DeCorso |
| 4,253,301 | A | | 3/1981 | Vogt |
| 4,288,980 | A | | 9/1981 | Ernst |
| 4,301,657 | A | * | 11/1981 | Penny ..... 60/748 |
| 4,687,436 | A | * | 8/1987 | Shigeta ..... 431/173 |

(Continued)

FOREIGN PATENT DOCUMENTS

| | | |
|---|---|---|
| EP | 2236935 | 6/2010 |
| EP | 2206964 A2 | 7/2012 |

(Continued)

OTHER PUBLICATIONS

Co-pending U.S. Appl. No. 13/466,184, Melton, et al. filed May 8, 2012.

(Continued)

*Primary Examiner* — Phutthiwat Wongwian
*Assistant Examiner* — Lorne Meade
(74) *Attorney, Agent, or Firm* — Dority & Manning, PA

(57) ABSTRACT

A system for supplying a working fluid to a combustor includes a combustion chamber, a liner that circumferentially surrounds at least a portion of the combustion chamber, and a flow sleeve that circumferentially surrounds at least a portion of the liner. A tube provides fluid communication for the working fluid to flow through the flow sleeve and the liner and into the combustion chamber, and the tube spirals between the flow sleeve and the liner.

16 Claims, 4 Drawing Sheets

(56) References Cited

U.S. PATENT DOCUMENTS

| | | | | |
|---|---|---|---|---|
| 4,926,630 | A * | 5/1990 | Shekleton | 60/804 |
| 4,928,481 | A * | 5/1990 | Joshi et al. | 60/737 |
| 5,054,280 | A | 10/1991 | Ishibashi et al. | |
| 5,099,644 | A | 3/1992 | Sabla et al. | |
| 5,127,229 | A | 7/1992 | Ishibashi et al. | |
| 5,297,391 | A | 3/1994 | Roche | |
| 5,321,948 | A | 6/1994 | Leonard | |
| 5,450,725 | A | 9/1995 | Takahara et al. | |
| 5,613,357 | A * | 3/1997 | Mowill | 60/39.23 |
| 5,623,819 | A | 4/1997 | Bowker et al. | |
| 5,687,572 | A * | 11/1997 | Schrantz et al. | 60/753 |
| 5,749,219 | A | 5/1998 | DuBell | |
| 5,974,781 | A | 11/1999 | Correa et al. | |
| 6,047,550 | A | 4/2000 | Beebe | |
| 6,178,737 | B1 | 1/2001 | Lenertz et al. | |
| 6,178,751 | B1 * | 1/2001 | Shekleton et al. | 60/736 |
| 6,192,688 | B1 | 2/2001 | Beebe | |
| 6,253,538 | B1 | 7/2001 | Sampath et al. | |
| 6,324,828 | B1 * | 12/2001 | Willis et al. | 60/773 |
| 6,868,676 | B1 | 3/2005 | Haynes | |
| 6,925,809 | B2 | 8/2005 | Mowill | |
| 6,935,116 | B2 | 8/2005 | Stuttaford et al. | |
| 7,137,256 | B1 | 11/2006 | Stuttaford et al. | |
| 7,162,875 | B2 | 1/2007 | Fletcher et al. | |
| 7,237,384 | B2 | 7/2007 | Stuttaford et al. | |
| 7,425,127 | B2 | 9/2008 | Zinn | |
| 7,665,309 | B2 | 2/2010 | Parker et al. | |
| 8,281,594 | B2 * | 10/2012 | Wiebe | 60/733 |
| 8,475,160 | B2 | 7/2013 | Campbell et al. | |
| 8,479,518 | B1 * | 7/2013 | Chen | 60/733 |
| 8,516,820 | B2 * | 8/2013 | Ramier et al. | 60/737 |
| 8,601,820 | B2 * | 12/2013 | Byrne et al. | 60/754 |
| 8,707,707 | B2 * | 4/2014 | Venkataraman et al. | 60/772 |
| 9,010,082 | B2 * | 4/2015 | Stoia et al. | 60/39.23 |
| 9,010,120 | B2 * | 4/2015 | DiCintio et al. | 60/746 |
| 2002/0189260 | A1 * | 12/2002 | David et al. | 60/746 |
| 2005/0095542 | A1 | 5/2005 | Sanders et al. | |
| 2005/0097889 | A1 | 5/2005 | Pilatis et al. | |
| 2007/0022758 | A1 | 2/2007 | Myers et al. | |
| 2007/0137207 | A1 | 6/2007 | Mancini et al. | |
| 2009/0084082 | A1 | 4/2009 | Martin et al. | |
| 2010/0018208 | A1 | 1/2010 | Ritland | |
| 2010/0018209 | A1 * | 1/2010 | Ramier et al. | 60/740 |
| 2010/0170254 | A1 * | 7/2010 | Venkataraman et al. | 60/746 |
| 2010/0174466 | A1 | 7/2010 | Davis, Jr. et al. | |
| 2010/0223930 | A1 * | 9/2010 | Chila | 60/752 |
| 2011/0056206 | A1 * | 3/2011 | Wiebe | 60/740 |
| 2011/0067402 | A1 | 3/2011 | Wiebe et al. | |
| 2011/0131998 | A1 | 6/2011 | Nadkarni et al. | |
| 2011/0146226 | A1 * | 6/2011 | Wood | 60/39.511 |
| 2011/0179803 | A1 | 7/2011 | Berry et al. | |
| 2011/0296839 | A1 | 12/2011 | Van Nieuwenhuizen et al. | |
| 2013/0008169 | A1 | 1/2013 | Belsom et al. | |
| 2013/0067921 | A1 * | 3/2013 | Hadley et al. | 60/746 |
| 2013/0283800 | A1 * | 10/2013 | Romig et al. | 60/733 |
| 2013/0283801 | A1 * | 10/2013 | Romig et al. | 60/733 |
| 2014/0174090 | A1 * | 6/2014 | Chen et al. | 60/740 |

FOREIGN PATENT DOCUMENTS

| | | |
|---|---|---|
| EP | 2613082 | 10/2013 |
| JP | 2006138566 | 6/2006 |
| WO | WO 2004/035187 A2 | 4/2004 |

OTHER PUBLICATIONS

Co-pending U.S. Appl. No. 13/349,886, Stoia, et al., filed Jan. 13, 2012.

Co-pending U.S. Appl. No. 13/344,877, Stoia, et al., filed Jan. 6, 2012.

Co-pending U.S. Appl. No. 13/349,906, Stoia, et al., filed Jan. 13, 2012.

Co-pending U.S. Appl. No. 13/420,715, Chen, et al., filed Mar. 15, 2012.

Co-pending U.S. Appl. No. 13/455,429, Romig, et al., filed Apr. 25, 2012.

Co-pending U.S. Appl. No. 13/455,480, Stoia, et al., filed Apr. 25, 2012.

Co-pending U.S. Appl. No. 14/122,694, Shershnyov, filed Nov. 27, 2013.

Co-pending U.S. Appl. No. 14/122,697, Shershnyov, filed Nov. 27, 2013.

* cited by examiner

SYSTEM FOR SUPPLYING A FUEL AND WORKING FLUID MIXTURE TO A COMBUSTOR

FIELD OF THE INVENTION

The present invention generally involves a system for supplying a working fluid to a combustor. In particular embodiments, the present invention may supply a lean fuel-air mixture to the combustion chamber through late lean injectors circumferentially arranged around the combustion chamber.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows into a combustion chamber where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by fuel nozzles, possibly causing severe damage to the fuel nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, one or more late lean injectors or tubes may be circumferentially arranged around the combustion chamber downstream from the fuel nozzles. A portion of the compressed working fluid exiting the compressor may flow through the tubes to mix with fuel to produce a lean fuel-air mixture. The lean fuel-air mixture may then be injected by the tubes into the combustion chamber, resulting in additional combustion that raises the combustion gas temperature and increases the thermodynamic efficiency of the combustor.

The late lean injectors are effective at increasing combustion gas temperatures without producing a corresponding increase in the production of $NO_X$. However, the tubes that provide the late injection of the lean fuel-air mixture typically have a substantially constant cross section that creates conditions around the late lean injectors susceptible to localized flame holding. In addition, the tubes are generally aligned perpendicular to the flow of combustion gases in the combustion chamber. As a result, the late lean injectors may produce large vortices that recirculate hot combustion gases back to the surface of the combustion chamber, producing high thermal gradients and shortening hardware life. Therefore, an improved system for supplying working fluid to the combustor that reduces the conditions for flame holding and/or vortex shedding would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supplying a working fluid to a combustor. The system includes a combustion chamber, a liner that circumferentially surrounds at least a portion of the combustion chamber, and a flow sleeve that circumferentially surrounds at least a portion of the liner. A tube provides fluid communication for the working fluid to flow through the flow sleeve and the liner and into the combustion chamber, and the tube spirals between the flow sleeve and the liner.

Another embodiment of the present invention is a system for supplying a working fluid to a combustor that includes a combustion chamber, a liner that circumferentially surrounds at least a portion of the combustion chamber, and a flow sleeve that circumferentially surrounds at least a portion of the liner. A tube provides fluid communication through the flow sleeve and the liner and into the combustion chamber, and the tube includes a first side that intersects the liner at a first acute angle, a second side opposite the first side that intersects the liner at a second angle, and the first acute angle is less than the second angle.

The present invention may also include a system for supplying a working fluid to a combustor that includes a combustion chamber, a liner that circumferentially surrounds at least a portion of the combustion chamber, and a flow sleeve that circumferentially surrounds at least a portion of the liner. A tube provides fluid communication for the working fluid to flow through the flow sleeve and the liner and into the combustion chamber. The tube includes an ovular cross-section having a longitudinal axis, and the longitudinal axis of the ovular cross-section is angled with respect to a longitudinal axis of the combustion chamber as the tube passes through the liner.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
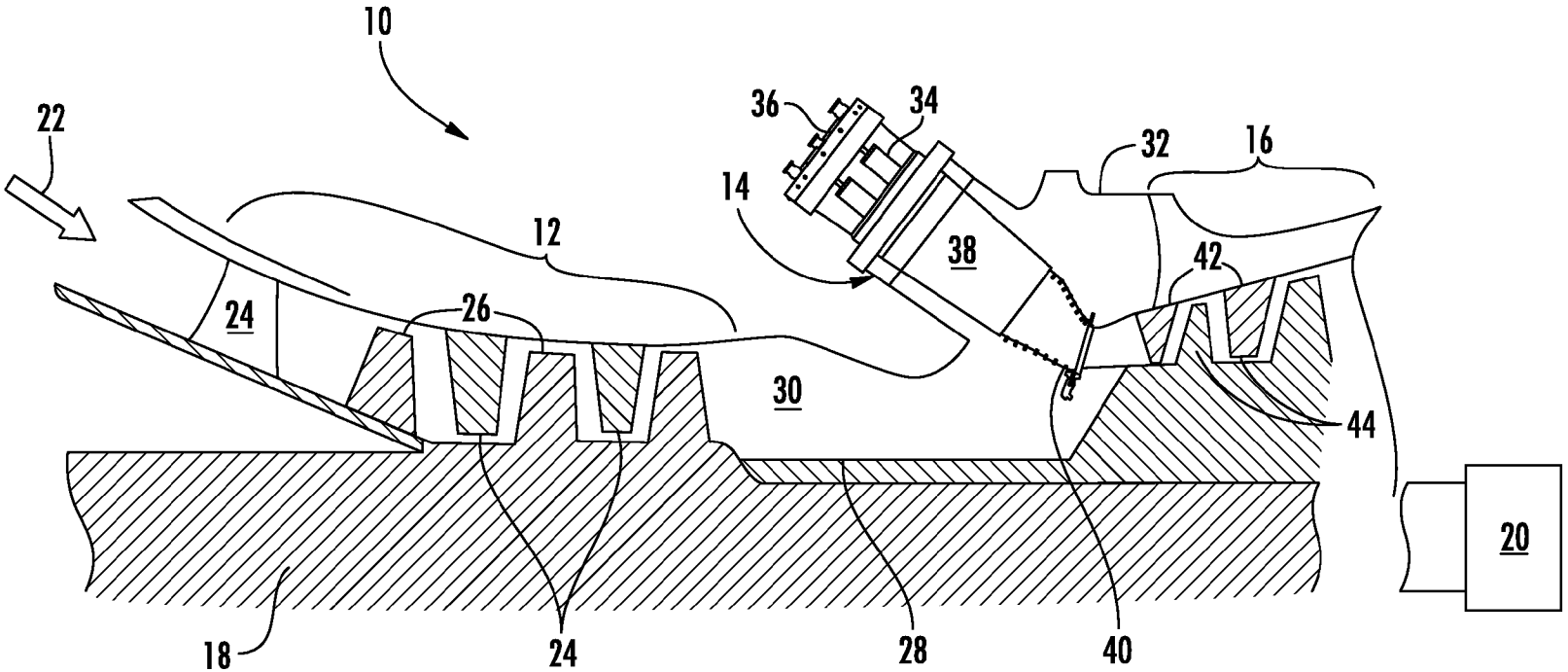
FIG. 1 is a simplified side cross-section view of an exemplary gas turbine.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system for supplying a working fluid to a combustor. The system generally includes one or more late lean injectors circumferentially arranged around a combustion chamber to inject a lean mixture of fuel and working fluid into the combustion chamber. In particular embodiments, the late lean injectors may have various geometric profiles to enhance injection of the lean mixture into the combustion chamber without increasing flame holding and/or vortex shedding. For example, the late lean injectors may include a spiraling profile, a tapered cross-section, and/or an ovular cross-section. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 provides a simplified cross-section view of an exemplary gas turbine 10 incorporating one embodiment of the present invention. As shown, the gas turbine 10 may include a compressor 12 at the front, one or more combustors 14 radially disposed around the middle, and a turbine 16 at the rear. The compressor 12 and the turbine 16 typically share a common rotor 18 connected to a generator 20 to produce electricity.

The compressor 12 may be an axial flow compressor in which a working fluid 22, such as ambient air, enters the compressor 12 and passes through alternating stages of stationary vanes 24 and rotating blades 26. A compressor casing 28 contains the working fluid 22 as the stationary vanes 24 and rotating blades 26 accelerate and redirect the working fluid 22 to produce a continuous flow of compressed working fluid 22. The majority of the compressed working fluid 22 flows through a compressor discharge plenum 30 to the combustor 14.

The combustor 14 may be any type of combustor known in the art. For example, as shown in FIG. 1, a combustor casing 32 may circumferentially surround some or all of the combustor 14 to contain the compressed working fluid 22 flowing from the compressor 12. One or more fuel nozzles 34 may be radially arranged in an end cover 36 to supply fuel to a combustion chamber 38 downstream from the fuel nozzles 34. Possible fuels include, for example, one or more of blast furnace gas, coke oven gas, natural gas, vaporized liquefied natural gas (LNG), hydrogen, and propane. The compressed working fluid 22 may flow from the compressor discharge plenum 30 along the outside of the combustion chamber 38 before reaching the end cover 36 and reversing direction to flow through the fuel nozzles 34 to mix with the fuel. The mixture of fuel and compressed working fluid 22 flows into the combustion chamber 38 where it ignites to generate combustion gases having a high temperature and pressure. The combustion gases flow through a transition piece 40 to the turbine 16.

The turbine 16 may include alternating stages of stators 42 and rotating buckets 44. The first stage of stators 42 redirects and focuses the combustion gases onto the first stage of rotating buckets 44. As the combustion gases pass over the first stage of rotating buckets 44, the combustion gases expand, causing the rotating buckets 44 and rotor 18 to rotate. The combustion gases then flow to the next stage of stators 42 which redirects the combustion gases to the next stage of rotating buckets 44, and the process repeats for the following stages.

Figure 2:
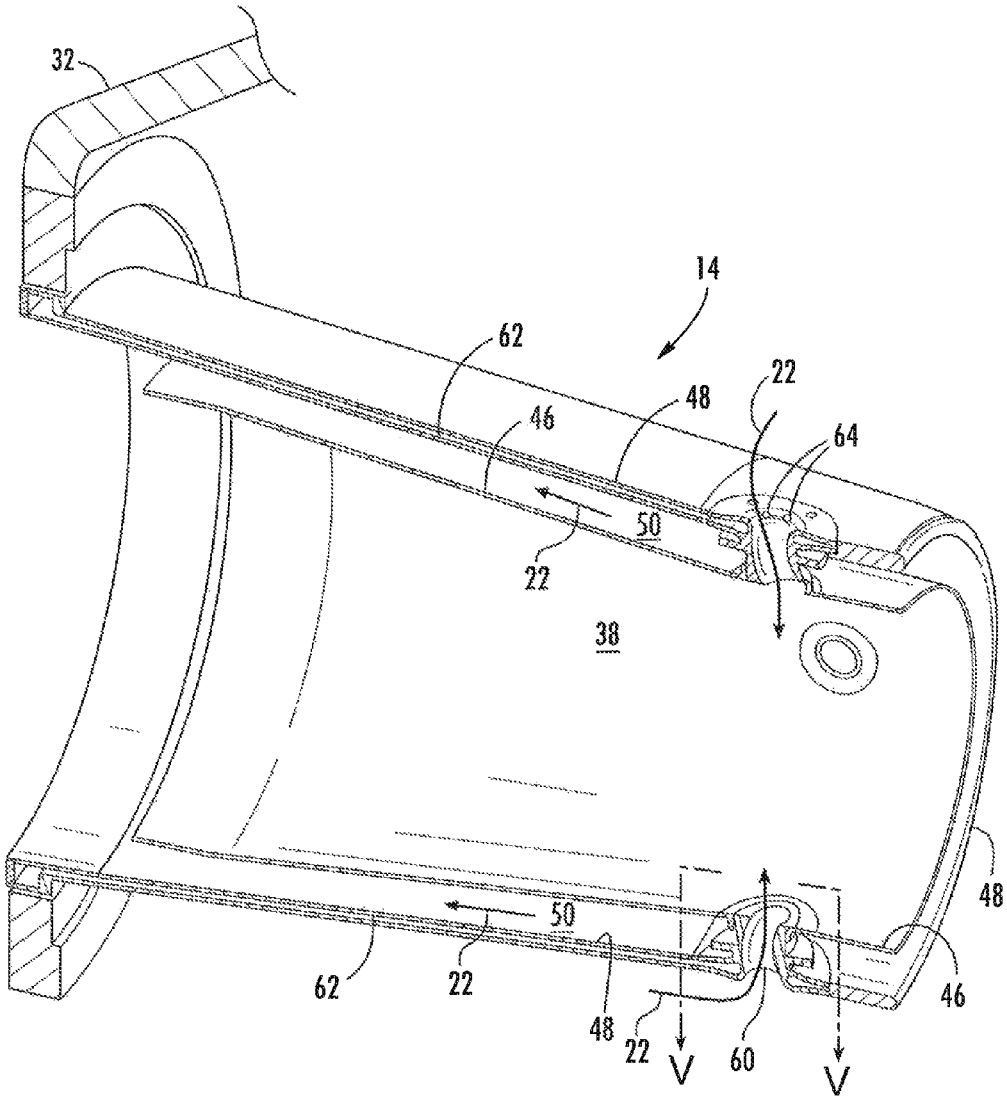
FIG. 2 is a simplified side perspective view of a portion of the combustor shown in FIG. 1 according to a first embodiment of the present invention.

FIG. 2 provides a simplified perspective view of a portion of the combustor 14 shown in FIG. 1 according to a first embodiment of the present invention. As shown, the combustor 14 may include a liner 46 that circumferentially surrounds at least a portion of the combustion chamber 38, and a flow sleeve 48 may circumferentially surround the liner 46 to define an annular passage 50 that surrounds the liner 46. In this manner, the compressed working fluid 22 from the compressor discharge plenum 30 may flow through the annular passage 50 along the outside of the liner 46 to provide convective cooling to the liner 46 before reversing direction to flow through the fuel nozzles 34 (shown in FIG. 1) and into the combustion chamber 38.

The combustor 14 may further include a plurality of late lean injectors or tubes 60 that may provide a late lean injection of fuel and compressed working fluid 22 into the combustion chamber 38. The tubes 60 may be circumferentially arranged around the combustion chamber 38, liner 46, and flow sleeve 48 downstream from the fuel nozzles 34 to provide fluid communication for the compressed working fluid 22 to flow through the flow sleeve 48 and the liner 46 and into the combustion chamber 38. As shown in FIG. 2, the flow sleeve 48 may include an internal fuel passage 62, and each tube 60 may include one or more fuel ports 64 circumferentially arranged around the tube 60. In this manner, the fuel passage 62 may provide fluid communication for fuel to flow through the fuel ports 64 and into the tubes 60. The tubes 60 may receive the same or a different fuel than supplied to the fuel nozzles 34 and mix the fuel with a portion of the compressed working fluid 22 before or while injecting the mixture into the combustion chamber 38. In this manner, the tubes 60 may supply a lean mixture of fuel and compressed working fluid 22 for additional combustion to raise the temperature, and thus the efficiency, of the combustor 14.

Figure 3:
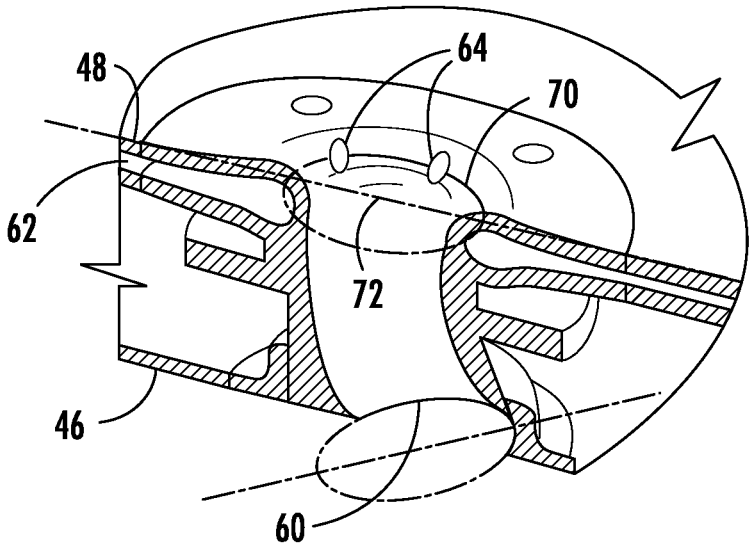
FIG. 3 is an enlarged side perspective view of the late lean injector shown in FIG. 2.
Figure 4:
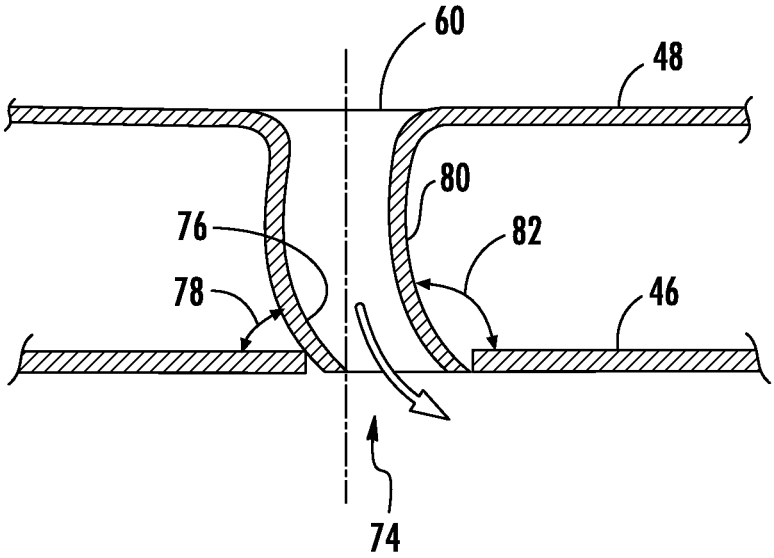
FIG. 4 is an enlarged side cross-section view of the late lean injector shown in FIG. 2.
Figure 5:
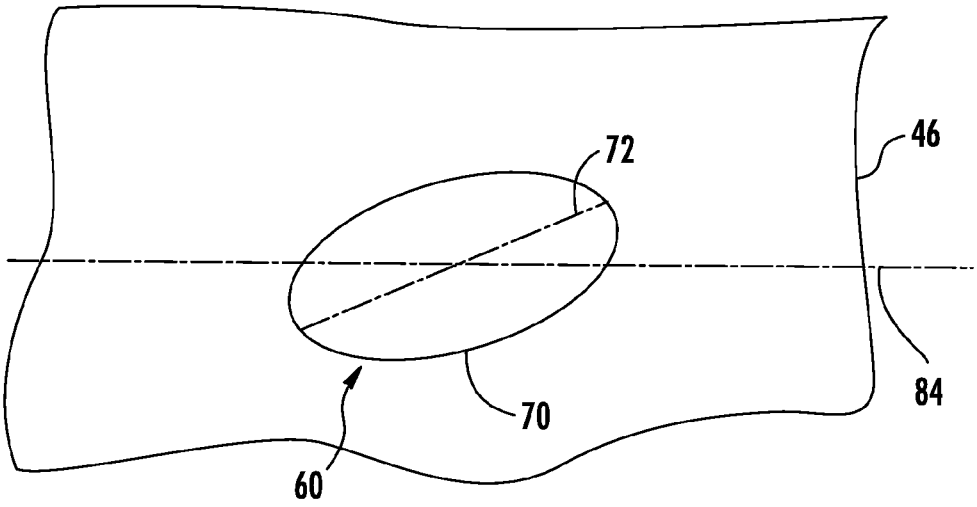
FIG. 5 is a plan view of the late lean injector shown in FIG. 2 from inside the combustion chamber.

FIGS. 3-5 provide enlarged perspective, cross-section, and plan views of the tubes 60 to illustrate various features and combinations of features that may be present in various embodiments of the tubes 60 within the scope of the present invention. For example, FIG. 3 provides an enlarged perspective view of the tube 60 shown in FIG. 2 to more clearly illustrate the shape and curvature of the tube 60 between the flow sleeve 48 and the liner 46 in one particular embodiment. As shown in FIG. 3, the tube 60 may include an elliptical cross-section 70 having a longitudinal axis 72. In addition, the longitudinal axis 72 of the tube 60 may spiral completely or partially between the flow sleeve 48 and the liner 46. The amount of spiraling will vary according to particular embodiments. For example, the longitudinal axis 72 may rotate up to 80 degrees or more in particular embodiments, depending on the distance between the flow sleeve 48 and the liner 46, the internal volume of the particular tube 60, the length of the longitudinal axis 72, and/or other design considerations. It is anticipated that the combination of the elliptical shape and spiraling will reduce pressure loss of the compressed working fluid 22 flowing through the tubes 60 and/or enhance mixing of the lean fuel-working fluid mixture with the combustion gases.

FIG. 4 provides an enlarged side cross-section view of the tube 60 shown in FIG. 2 to illustrate that the tube 60 may include a tapered end 74 that passes through the liner 46. For example, the tapered end 74 may reduce the cross-sectional area of the tube by 2-50 percent or more at the intersection of the liner 46 to accelerate the fluid injection into the combustion chamber 38 and reduce the occurrence of flame holding and/or flash back near the tubes 60. In particular embodiments, the tapered end 74 may be symmetric or asymmetric. For example, as shown in FIG. 4, the tapered end 74 may include a first side 76 that intersects the liner 46 at a first acute angle 78, a second side 80 opposite the first side 76 that intersects the liner 46 at a second angle 82. For consistency and convention, the first acute angle 78 and the second angel 82 are measured at the intersection of the first and second sides 76, 80, respectively, with the liner 46 from the outside of the tube 60. The first acute angle 78 may be, for example, 2-25 degrees, depending on the particular embodiment, and the first acute angle 78 may be less than the second angle 82. The resulting asymmetry at the tapered end 74 may not only accelerate the fluid injection into the combustion chamber 38, but it may also reduce vortex shedding and the associated recirculation of hot combustion gases near the liner 46 created by the injected fluid.

FIG. 5 provides a plan view of the tube 60 shown in FIG. 2 from inside the combustion chamber 38. As shown, the longitudinal axis 72 of the ovular cross-section 70 may be angled with respect to a longitudinal axis 84 of the combustion chamber 38 as the tube 60 passes through the liner 46. As a result, particularly when combined with the spiraling feature shown in FIG. 3 and/or the tapered end 74 shown in FIG. 4, the injected lean fuel-working fluid mixture may penetrate further into the combustion chamber 38 to enhance mixing between the combustion gases and the injected fluids.

One of ordinary skill in the art will readily appreciate from the teachings herein that the tubes 60 shown in FIG. 2 may include only one or more than one of the features described and illustrated in more detail in FIGS. 3-5, and embodiments of the present invention are not limited to any combination of such features unless specifically recited in the claims. In addition, the particular embodiments shown and described with respect to FIGS. 1-5 may also provide a method for supplying the working fluid 22 to the combustor 14. The method may include flowing the working fluid 22 from the compressor 12 through the combustion chamber 38 and diverting or flowing a portion of the working fluid 22 through the tubes 60 circumferentially arranged around the combustion chamber 38. In particular embodiments, the method may further include spiraling and/or accelerating the diverted portion of the working fluid 22 inside the tubes 60 prior to injection into the combustion chamber 38. The various features of the tubes 60 described herein may thus reduce the conditions conducive to flame holding near the tubes 60, reduce vortex shedding and recirculation zones near the tubes 60, and/or enhance fluid penetration and mixing inside the combustion chamber 38 to enhance NOx reduction.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for supplying a working fluid to a combustor, comprising:

a. a combustion chamber;

b. a liner that circumferentially surrounds at least a portion of the combustion chamber;

c. a flow sleeve having an inner sleeve that circumferentially surrounds at least a portion of the liner, an outer sleeve that circumferentially surrounds the inner sleeve and a fuel passage defined by and between the inner and outer sleeves;

d. a tube that provides fluid communication for the working fluid to flow through the flow sleeve and the liner and into the combustion chamber, wherein the tube spirals between the flow sleeve and the liner; and e. a plurality of fuel ports circumferentially arranged around an inlet of the tube, wherein each fuel port is in fluid communication with the fuel passage.

2. The system as in claim 1, wherein the tube comprises a tapered end that passes through the liner.

3. The system as in claim 2, wherein the tapered end is asymmetric.

4. The system as in claim 2, wherein the tapered end comprises a first side that intersects the liner at a first acute angle, a second side opposite the first side that intersects the liner at a second angle, and the first acute angle is less than the second angle.

5. The system as in claim 1, wherein the tube comprises an elliptical cross-section having a longitudinal axis.

6. The system as in claim 5, wherein the longitudinal axis of the elliptical cross-section is angled with respect to a longitudinal axis of the combustion chamber as the tube passes through the liner.

7. The system as in claim 1, wherein the tube comprises a tapered end that passes through the liner and an elliptical cross-section having a longitudinal axis.

8. A system for supplying a working fluid to a combustor, comprising:

a. a combustion chamber;

b. a liner that circumferentially surrounds at least a portion of the combustion chamber;

c. a flow sleeve having an inner sleeve that circumferentially surrounds at least a portion of the liner, an outer sleeve that circumferentially surrounds the inner sleeve and a fuel passage defined by and between the inner and outer sleeves;

d. a tube that provides fluid communication through the flow sleeve and the liner and into the combustion chamber, wherein the tube comprises a first side that intersects the liner at a first acute angle, a second side opposite the first side that intersects the liner at a second angle, and the first acute angle is less than the second angle; and e. a plurality of fuel ports circumferentially arranged around an inlet of the tube, wherein each fuel port is in fluid communication with the fuel passage.

9. The system as in claim 8, wherein the tube spirals between the flow sleeve and the liner.

10. The system as in claim 8, wherein the tube comprises an elliptical cross-section having a longitudinal axis.

11. The system as in claim 10, wherein the longitudinal axis of the elliptical cross-section is angled with respect to a longitudinal axis of the combustion chamber as the tube passes through the liner.

12. The system as in claim 8, wherein the tube comprises an elliptical cross-section having a longitudinal axis that spirals between the flow sleeve and the liner.

13. A system for supplying a working fluid to a combustor, comprising:

a. a combustion chamber;

b. a liner that circumferentially surrounds at least a portion of the combustion chamber;

c. a flow sleeve having an inner sleeve that circumferentially surrounds at least a portion of the liner, an outer sleeve that circumferentially surrounds the inner sleeve and a fuel passage defined by and between the inner and outer sleeves;

d. a tube that provides fluid communication for the working fluid to flow through the flow sleeve and the liner and into the combustion chamber, wherein the tube comprises an elliptical cross-section having a longitudinal axis, and the longitudinal axis of the elliptical cross-section is angled with respect to a longitudinal axis of the combustion chamber as the tube passes through the liner; and e. a plurality of fuel ports circumferentially arranged around an inlet of the tube, wherein each fuel port is in fluid communication with the fuel passage.

14. The system as in claim 13, wherein the tube spirals between the flow sleeve and the liner.

15. The system as in claim 13, wherein the tube comprises a tapered end that passes through the liner.

16. The system as in claim 15, wherein the tapered end comprises a first side that intersects the liner at a first acute angle, a second side opposite the first side that intersects the liner at a second angle, and the first acute angle is less than the second angle.

* * * * *